US005398461A

United States Patent [19]

Rose

[11] Patent Number: 5,398,461

[45] **Date of Patent: * Mar. 21, 1995**

[54] APPARATUS AND METHOD FOR CLEANING A PIPELINE

[75] Inventor: James L. Rose, Brookshire, Tex.

[73] Assignee: E. B. Thomas, Brookshire, Tex.

[ * ] Notice: The portion of the term of this patent subsequent to Feb. 4, 2009 has been disclaimed.

[21] Appl. No.: 27,837

[22] Filed: Mar. 8, 1993

Related U.S. Application Data

[63] Continuation-in-part of Ser. No. 840,286, Feb. 24, 1992, Pat. No. 5,191,740, which is a continuation of Ser. No. 646,499, Jan. 28, 1991, Pat. No. 5,107,633, which is a continuation-in-part of Ser. No. 470,819, Jan. 26, 1990, abandoned.

[51] Int. Cl.[6] ..... B24C 3/06

[52] U.S. Cl. ..... 451/92; 15/104.04

[58] Field of Search ..... 51/429, 411, 426; 118/306, 326, DIG. 4; 134/175, 177, 199, 200; 15/104.04

[56] References Cited

U.S. PATENT DOCUMENTS

| | | | |
|---|---|---|---|
| 1,910,497 | 5/1933 | Peik . | |
| 2,621,446 | 12/1952 | Russell . | |
| 3,362,109 | 1/1968 | Wallace . | |
| 3,994,766 | 11/1976 | Dedels | 156/392 |
| 4,007,705 | 2/1977 | Sherer et al. | 118/7 |
| 4,205,694 | 6/1980 | Thompson et al. | 134/181 |
| 4,237,817 | 12/1980 | Hart et al. | 118/307 |
| 4,552,594 | 11/1985 | Van Voskuilen et al. | 134/34 |
| 4,595,607 | 6/1986 | Betteridge et al. | 427/185 |
| 4,603,516 | 8/1986 | Hoffman | 51/425 |
| 4,677,998 | 7/1987 | Van Voskuilen et al. | 134/181 |
| 4,953,496 | 9/1990 | Taylor et al. | 118/72 |
| 5,052,423 | 10/1991 | Chapman et al. | 134/181 |
| 5,056,271 | 10/1991 | Rose | 51/319 |
| 5,069,234 | 12/1991 | Nielsen | 134/113 |
| 5,074,323 | 12/1991 | Chapman et al. | 134/74 |
| 5,085,016 | 2/1992 | Rose | 51/429 |
| 5,091,034 | 2/1992 | Hubert | 156/344 |
| 5,092,357 | 3/1992 | Chapman et al. | 134/181 |
| 5,107,633 | 4/1992 | Rose | 51/429 |
| 5,191,740 | 3/1993 | Rose | 51/429 |

FOREIGN PATENT DOCUMENTS

| | | |
|---|---|---|
| 988403 | 5/1976 | Canada . |
| 1043056 | 11/1978 | Canada . |
| 1080918 | 7/1980 | Canada . |
| 1131418 | 9/1982 | Canada . |
| 1211352 | 9/1986 | Canada . |
| 0214841 | 3/1987 | European Pat. Off. . |
| 0343878 | 11/1989 | European Pat. Off. . |

*Primary Examiner*—Robert A. Rose
*Attorney, Agent, or Firm*—Bush, Moseley, Riddle & Jackson

[57] ABSTRACT

Apparatus for cleaning the outer surface of a pipeline (10, 10B, 10C) including a self propelled carriage (28, 28B, 28C) supported on the pipeline for movement. A housing (30, 30B, 30C) forms an enclosed cleaning chamber about the pipeline and the cleaning material along with entrained waste material removed from the pipeline may be conveyed by a suitable conduit (40) from a discharge opening in the bottom of the housing (30, 30B, 30C) for separation of the cleaning material and waste material and return of the separate water to the housing in a recirculation system. The embodiment of FIGS. 11–15 is particularly adapted for use with high pressure water and includes a plurality of nozzle units (91C) mounted externally on the housing (30C) with each unit (91C) having a hydraulic fluid drive motor (96C) operatively connected to a nozzle (94C) for pivoting of the nozzle (94C) back and forth in an arcuate path. High pressure water is supplied to a tube or tubular shaft (90C) connected to the nozzle (94C). An embodiment of FIG. 16 illustrates a fixed installation for the cleaning apparatus with the pipe being moved through the apparatus for cleaning.

24 Claims, 8 Drawing Sheets

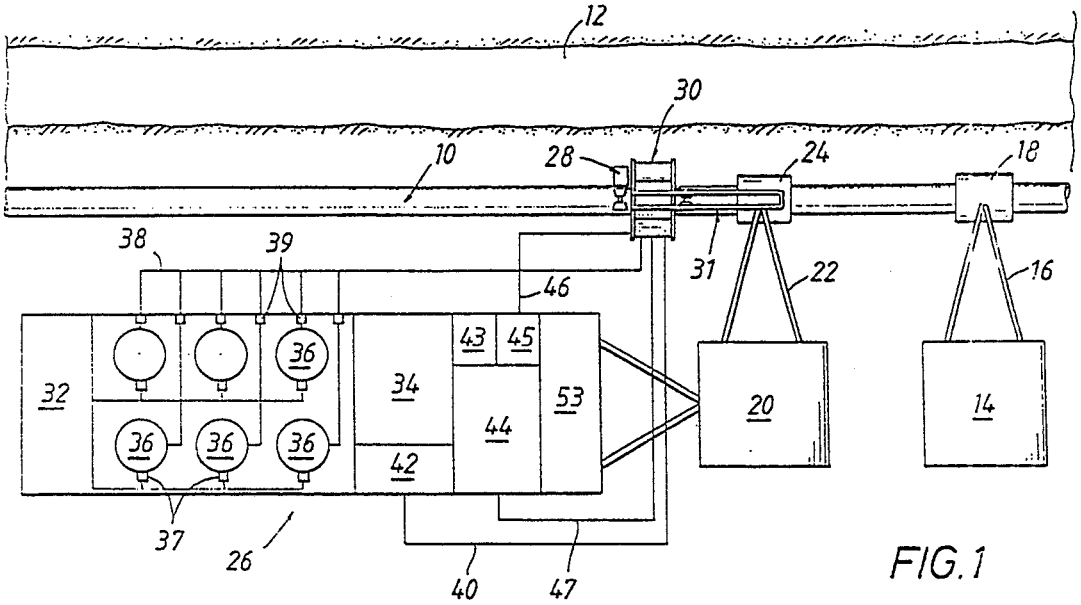
FIG. 1
FIG. 5
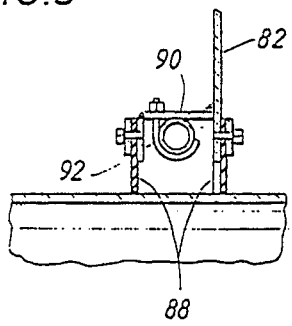
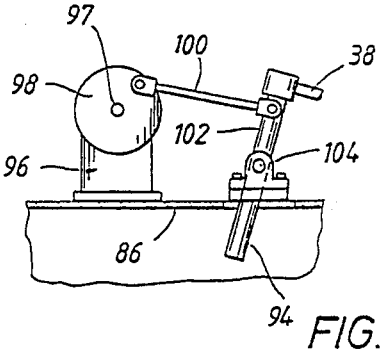
FIG. 6
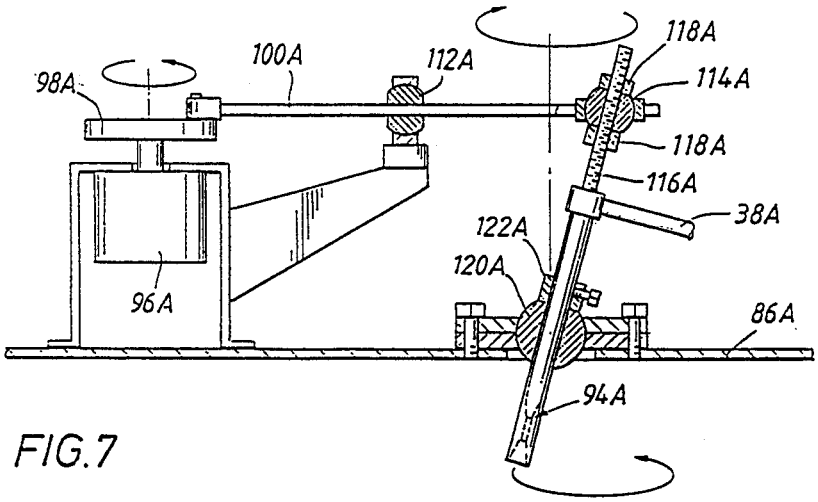
FIG. 7

FIG. 14
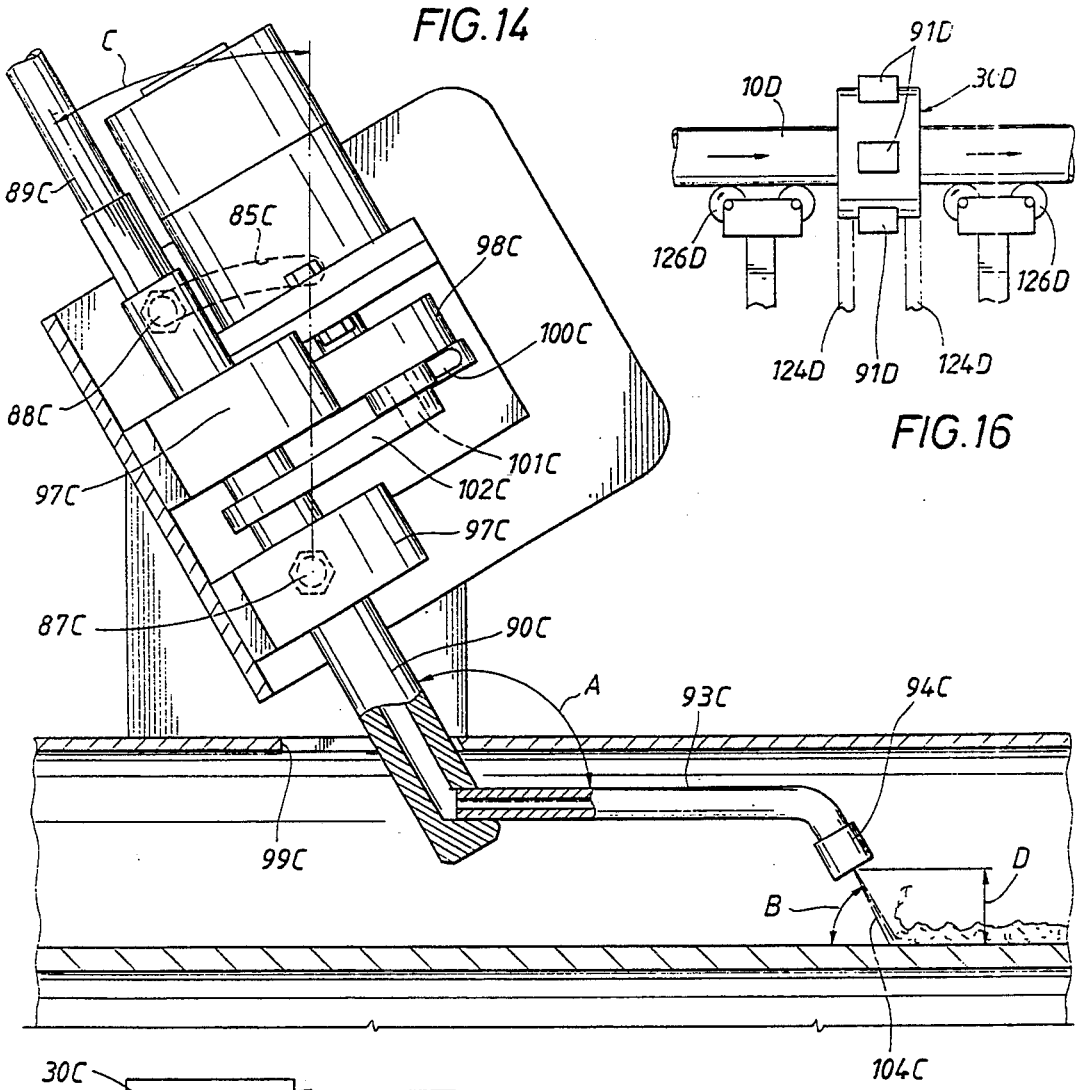
FIG. 16
FIG. 15
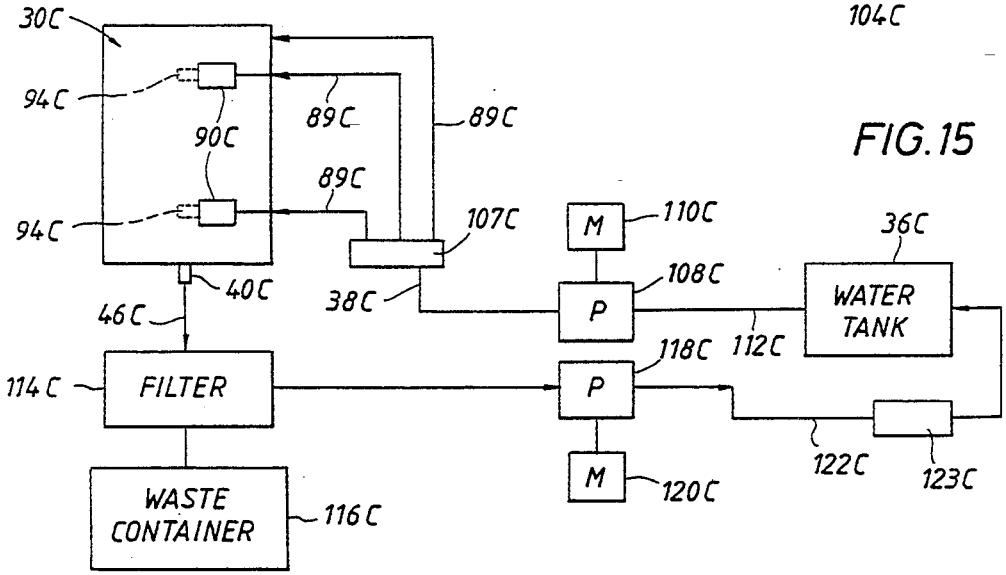

APPARATUS AND METHOD FOR CLEANING A PIPELINE

REFERENCE TO RELATED APPLICATIONS

This application is a continuation-in-part of application Ser. No. 840,286, filed Feb. 24, 1992, now U.S. Pat. No. 5,191,740, dated Mar. 9, 1993; which is a continuation of application Ser. No. 646,499, filed Jan. 28, 1991, now U.S. Pat. No. 5,107,633, dated Apr. 28, 1992; which is a continuation-in-part of application Ser. No. 470,819, filed Jan. 26, 1990, abandoned.

BACKGROUND OF THE INVENTION

This invention relates to an apparatus and method for cleaning a pipeline, and more particularly to such a method and apparatus for cleaning the outside of the pipeline including a self propelled carriage moving along the pipeline.

Heretofore, apparatus has been provided including a self propelled carriage or vehicle, such as shown in U.S. Pat. No. 4,603,516 for cleaning the outside of pipe or pipeline as the self propelled carriage moves along a pipeline while supported thereon. Cleaning the outside of pipe removes loose rust, scale and dirt, to prepare the pipe for the subsequent application of a coating material on the outer surface of the pipe to minimize corrosion and prolong the service life of the pipe. In some instances, the pipe may be wrapped with an outer lining material containing an inner coating material for contacting the outer cleaned surface of the pipe. Normally abrasive particles, such as hard shot particles or grit, have been thrown by centrifugal force from an impeller wheel or the like against the outside of the pipe for cleaning the pipe. Particularly where hard shot particles of a uniform size were used previously, a relatively smooth clean outer surface of pipe was provided. The terms "pipe" and "pipeline" are interpreted herein as being the same.

It is desirable to have a roughness on the outer surface of the pipe to provide a strong bond between the pipe and coating. The roughness increases the surface area of the pipe in contact with the coating for "anchoring" the coating on the pipe. Such an increased area bond is particularly needed upon an expansion of the pipe resulting from pressure or temperature increases to maintain the bonding contact between the pipe and coating. The greater the roughness, the stronger the bond between the pipe and coating particularly for shearing stresses. An enclosed blast chamber or housing on a self propelled carriage travelling along the pipe has been utilized previously but such carriages have been relatively complex for carrying blast wheels or impellers and for assembly on and disassembly off the pipe.

Oftentimes, high pressure water is utilized for the cleaning of pipe. For example, as shown in U.S. Pat. No. 5,092,357 dated Mar. 3, 1992, a self propelled apparatus travels along a pipeline and discharges high pressure water from rotating water jets or nozzles for cleaning the outer surface of the pipeline. As shown in U.S. Pat. No. 4,552,594, a self propelled vehicle discharges high pressure water from nozzles mounted on a frame which oscillates as the apparatus moves along the pipeline for cleaning the outer surface of the pipeline.

An enclosed chamber or housing is normally provided on a travelling carriage of the pipe cleaning apparatus for maintaining the high pressure water or other cleaning material in an enclosed volume about the pipe.

However, the carriages heretofore for supporting the housing and discharge nozzles for assembly on and disassembly off the pipe have been relatively complex. It is noted that in some instances a non-uniform cleaning of the pipe has been obtained as the distance of the nozzles to the outer periphery of the pipe varies substantially throughout the movement or stroke of the nozzle resulting in the water jets striking the outer periphery of the pipe at different velocities at different portions of the stroke. Thus, a non-uniform cleaning action may be obtained.

SUMMARY OF THE INVENTION

The present invention includes a self propelled carriage adapted to be easily assembled about a pipe for movement along the pipe and to be easily removed from the pipe. The carriage includes a support frame having rollers for contacting and supporting the carriage on the pipe for movement along the pipe. An enclosed housing or chamber on the carriage is formed by body sections mounted for outward swinging or pivotal movement in an open position for lowering onto the pipe. Upon contact of the upper support frame with the pipe, the body sections are pivoted downwardly about the pipe and latched with the support frame of the carriage supported on the pipe for self propelled movement along the pipe. The self propelled carriage may be easily removed from the pipe by unlatching the body sections and swinging the body sections to an open position removed from the pipe. Then, the carriage may be lifted by the upper support frame for removal from the pipe.

The apparatus and method of the present invention includes a carriage or self propelled vehicle movable along the pipeline and an enclosed chamber or housing about the entire outer periphery of the pipe when assembled about the pipe. Discharge nozzles may be mounted for movement in a transverse direction relative to the longitudinal axis of the pipe and may be spaced about the periphery of the pipe to cover a predetermined surface area such as, for example, an arcuate area of sixty degrees about the outer periphery of the pipe. In one embodiment, the nozzles are separately mounted externally on a relatively fixed housing surrounding the pipeline and forming an enclosed cleaning chamber about the pipeline. Each nozzle is mounted for separate pivoting movement and defines a generally arcuate back and forth travel path. A separate hydraulic motor mounted externally on the housing is provided for each of the nozzles and linkage including an eccentric is connected between the hydraulic motor and nozzle to provide the desired arcuate path as the nozzle pivots, Normally, an arcuate path generally conforming to the outer periphery as the pipeline is desired in order to maintain the nozzle at a generally constant distance from the outer periphery of the pipe through the entire movement of the nozzle. Thus, the novel pivotal movement of each nozzle about its longitudinal axis transcribe a generally arcuate path.

In another embodiment, the nozzles are fixed externally to the enclosed housing about the pipeline and the entire housing along with the nozzles fixed thereon oscillate back and forth in a direction transversely of the longitudinal axis of the pipe thereby to clean the entire outer periphery of the pipe. The box-like housing is supported for oscillation on rollers supported from the main carriage frame and means oscillate the housing and nozzles fixed thereto back and forth in a predetermined arcuate path on the rollers such as to provide a back and forth arcuate movement of sixty degrees in each direction, for example. Thus, if six nozzles are used, the entire outer periphery of the pipe will be cleaned as a result of the oscillation of the entire housing and nozzles thereon. The nozzles remain at a constant distance from the outer periphery of the pipe during the arcuate travel of the housing thereby to provide a constant velocity and uniform cleaning action against the pipe throughout the arcuate back and forth travel of the enclosed housing.

The self propelled carriage also includes an outer enclosed housing or shell about the pipeline which collects the water and waste material or debris from the cleaning operation and returns the water and waste material to adjacent apparatus for separation and recycling. Certain materials removed from the pipe, such as asbestos, are hazardous or environmentally unacceptable and are collected for disposal at a separate approved disposal site. As a result of Having a housing about the pipeline forming an enclosed cleaning chamber, it may be desirable to remove the cleaning material and entrained removed waste material from the housing particularly if a continuous recirculation system is desired for high pressure water. The waste material and high pressure water are discharged from a discharge outlet in the enclosed housing to suitable mobile apparatus adjacent the pipe for removing and/or collecting the waste material from the water, filtering and cooling the water, and then pressurizing and returning the clean high pressure water to the housing to provide a continuous recirculation system. Thus, a self-contained water recycling system and waste collection system is provided without the utilization of any separate vacuum or pump trucks. As a result of the above, a minimal amount of water is required for the cleaning operation.

It is an object of the present invention to provide a method and apparatus for cleaning the outer periphery of a pipeline in a generally uniform cleaning action as a self propelled carriage supported on the pipeline moves longitudinally along the pipeline.

It is a further object of this invention to provide such a method and apparatus in which the self propelled carriage has an enclosed housing about the pipeline defining an enclosed cleaning chamber in which the cleaning material is discharged from nozzles in high velocity streams against the pipeline.

Another object is to provide such an apparatus and method in which the cleaning material, such as high pressure water, is separated from entrained waste material and returned to the housing in a continuous water recirculation system.

A further object is to provide a self propelled vehicle or carriage having an enclosed housing about the pipeline with nozzles and external drive means therefor mounted externally of the housing for pivoting of the nozzles.

It is a further object of this invention to provide a self propelled carriage for movement along a pipe having an enclosed housing about the pipe supporting a plurality of arcuately spaced discharge nozzles fixed thereon with the housing and nozzles mounted for pivotal movement in an arcuate path relative to the outer periphery of the pipe for cleaning the pipe.

Other objects, features, and advantages of this invention will become more apparent after referring to the following specification and drawings.

DESCRIPTION OF THE INVENTION

FIG. 1 is a schematic of the apparatus of the present invention for cleaning the outer periphery of a pipe including a carriage travelling along the pipe and having an enclosed housing with nozzles for discharging cleaning material in a high velocity stream against the outer periphery of the pipe to clean the pipe;

FIG. 5 is an enlarged section taken along line 5—5 of FIG. 3 and showing means on the housing for sealing against the pipe;

FIG. 6 is an enlarged section taken generally along line 6—6 of FIG. 2 and showing means for oscillating the nozzles for the discharge of cleaning material in a high velocity stream against the outer surface of the pipe;

FIG. 7 is an enlarged view of a modified nozzle arrangement in which a nozzle is mounted for movement in a generally circular path;

FIG. 14 is a section taken generally along line 14—14 of FIG. 13 and showing the mounting of the nozzle for pivoting back and forth in an arcuate path;

FIG. 15 is a schematic of the high pressure water recirculation system particularly for the embodiment of FIGS. 11–14; and FIG. 16 is a schematic of a further embodiment of the invention in which the high pressure water cleaning apparatus shown in the embodiment of FIGS. 11–15 is fixed and the pipe is moved through the fixed cleaning apparatus.

DESCRIPTION OF THE INVENTION

Figure 2:
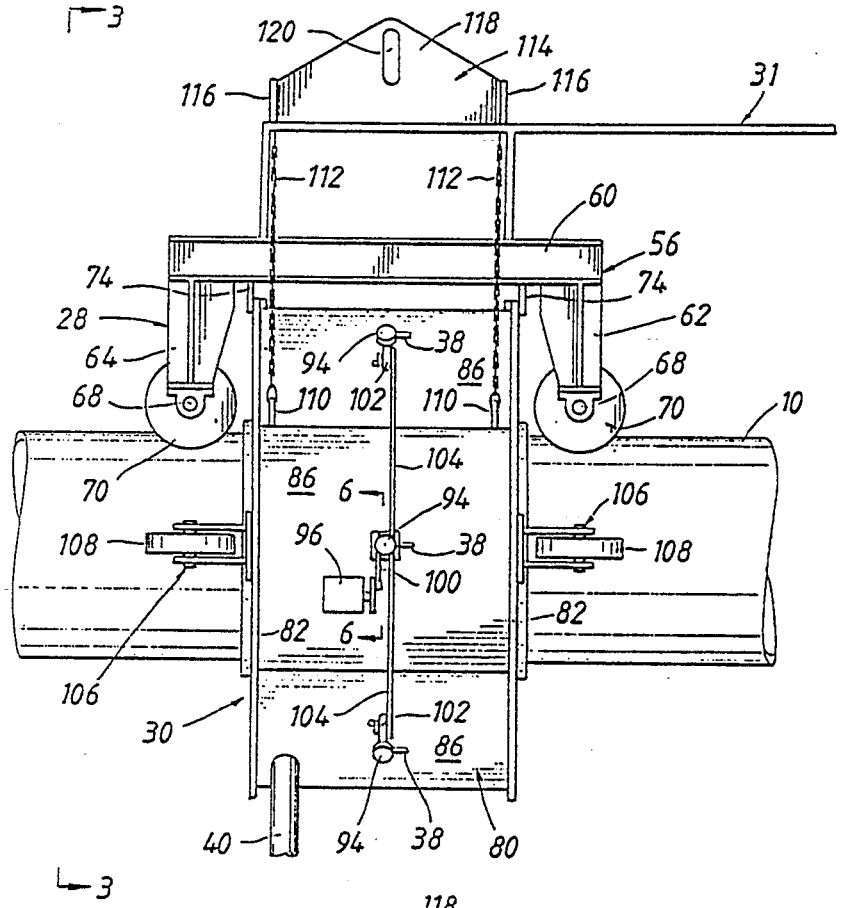
FIG. 2 is a side elevation of a preferred embodiment of the carriage mounted on the pipe and having an upper frame supporting the enclosed housing about the pipe for relative pivotal movement.
Figure 3:
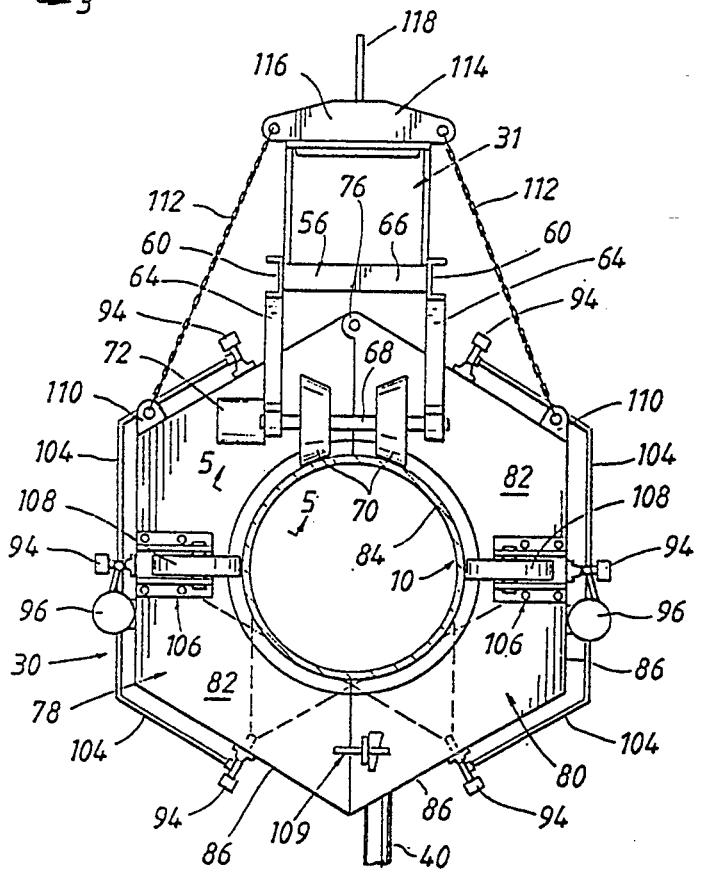
FIG. 3 is an end elevation of the carriage shown in FIG. 2 in position about a pipe for travelling along the pipe and taken generally along line 3—3 of FIG. 2.

Referring now to the drawings for a better understanding of this invention and more particularly to FIG.

1, apparatus for cleaning a pipe in accordance with this invention is illustrated. The pipe or pipeline is shown generally at 10 for cleaning its outer surface of coating material and/or removal of rust scales or the like. Pipe 10 is supported above the ground for cleaning and for coating after being cleaned. Thereafter pipe 10 is placed within a ditch 12 alongside the pipe and covered with soil or gravel. For supporting pipeline 10 above the ground, a front side boom tractor shown at 14 has a side boom 16 supporting a roller pipe support 18 mounted under pipe 10 and having rollers thereon for supporting the lower surface of pipe 10. A rear side boom tractor is shown at 20 having a side boom 22 and a roller pipe support 24 under pipe 10 for supporting the pipe.

Rear tractor 20 pulls a trailer or skid indicated generally at 26 alongside pipe 10 which contains the supplies and power sources for operating a self propelled carriage shown generally at 28 mounted on pipe 10 behind roller support 24. Self propelled carriage 28 includes a housing 30 forming an enclosed chamber about pipe 10 for the discharge of cleaning material against the outside of pipe 10 for cleaning and providing a rough outer finish to pipe 10 for the application of a coating. A frame 31 secured to carriage 28 extends to a position over roller support 24 and is contacted by cable from boom 22 in the event carriage 28 lags behind roller support 24 thereby to maintain carriage 28 at a certain transverse location on pipe 10.

Carriage 28 is adapted for the discharge of cleaning material from discharge nozzles in a high velocity stream for contacting the outer surface of pipe 10. The cleaning material may vary depending on the material to be removed from the outer surface of pipe 10. At times, tar or a bituminous layer may be on the outer surface the pipe and pressurized water may be utilized. In the event rust scales are desired to be removed a grit material is normally discharged in a high velocity stream, such as air, to removed the rust scales and clean the outside of pipe 10. If it is desired to remove rust scales, skid 26 includes an air compressor 32, a grit storage bin 34, a plurality of grit pots or containers 36 each having a separate discharge line 38 for supplying grit entrained in air to a discharge nozzle on housing 30. A hand operated control valve 37 is provided between air compressor 32 and each grit pot 36. An air operated valve 39 is provided in each line 38 adjacent the associated grit pot 36 for control of the supply of grit or abrasive particles to housing 30.

The abrasive particles and removed foreign matter such as rust scales and the like are returned from a discharge opening in the bottom of housing 30 through return line 40 to a cleaner 42 for removal of the foreign matter and return of the abrasive particles to supply bin 34 for recycling. In the event high pressure water is utilized as the cleaning material, the water and entrained waste material from the cleaning operation may be returned through return line 40. Then, the waste material may be filtered from the water and the water pressurized by a suitable pump for return to housing 30 through supply line 38 thereby to provide a continuous recirculation system for the water. A suitable water tank and pump may be provided adjacent air compressor 32 for supply of pressurized water through lines 38 to housing 30. A hydraulic reservoir is shown at 44 on skid 26 and a hydraulic pump 45 supplies pressurized hydraulic fluid through line 46 to self propelled carriage 28. A suitable diesel engine 43 may be provided for driving hydraulic pump 45 and a water pump if utilized. A hydraulic fluid return line 47 is shown for return of fluid to reservoir 44. Skid 26 also includes a control area at 53 for an operator to control the operation including the control of air operated valves 39 and the energizing of hydraulic pump 45.

Now, referring particularly to the embodiment of the invention shown in FIGS. 2–6, carriage 28 includes an upper support frame generally indicated at 56 supporting an enclosed housing generally indicated at 30. Frame 56 has a pair of horizontally extending channel-shaped members 60 arranged in parallel spaced relation to each other. Each horizontal frame members 60 has front and rear legs 62 and 64. A reinforcing member 66 extends between front legs 62 and rear legs 64. A shaft or axle 68 extends between front legs 62 and rear legs 64. Tapered rollers 70 are fixed to axles 68 for contacting the upper surface of pipe 10 and supporting carriage 28 thereon. For driving or propelling carriage 28 along pipe 10 a hydraulic motor 72 is connected to shaft 68 for rotating shaft 68 and associated rollers 70. Motor 72 is preferably connected to front shaft 68 but may, if desired, be connected to rear shaft 68. Hydraulic fluid from pump 45 is supplied to hydraulic motor 72.

A pair of hanger brackets 74 are secured between and extend downwardly from upper frame members 60 supporting enclosed housing 30 for relative movement about pivot axes 76. Housing 30 comprises a pair of housing sections or halves 78 and 80 pivotally connected to each other about pivot axes 76 for inward and outward swinging movement relative to pipeline 10. Housing 30 includes a pair of spaced ends 82 having arcuate openings 84 to receive pipe 10. A peripheral wall formed of six sides 86 extends between and is secured to ends 82 to form an enclosed chamber when in position about pipe 10. Each housing half 78, 80 is generally identical and included three walls or sides 86 connected to each other at 120 degrees thereby to provide a hexagonal shape to housing 30. It is to be understood that the peripheral wall may be formed of any desired number of sides or may be of a cylindrical shape, if desired.

For sealing about pipe 10 and referring particularly to FIG. 5, a pair of annular elastomeric seals 88 adjacent each end wall 88 wipe against the outer surface of pipe 10 as carriage 28 travels along the pipe. An angle 90 is secured to adjacent end wall 82 and seals 88 are secured to angle 90 and end wall 82. A plurality of spaced hangers 94 are mounted on angle 90 to mount a perforated conduit 92 about pipe 10 which is connected to a suitable air source for discharging air from the perforations in conduit 92 against pipe 10. Leading conduit 92 provides an initial cleaning action and trailing conduit 92 tends to remove any deposits of scales or foreign material remaining on pipe 10 after housing 30 has moved over pipe 10. Also, adjustment of seals 88 permits housing 30 to be utilized with pipe 10 of different diameters, such as diameters having a difference as much as around six inches for example.

For the discharge of cleaning material, such as pressurized water or grit entrained in a high velocity air stream, a discharge nozzle 94 is mounted within an opening in each side 86 for oscillating movement and has an inner discharge end directed against pipe 10. Housing sections 78, 80 have hydraulic motors 96 mounted thereon with a shaft 97 for each motor 96 connected to an eccentric 98 having links 100 pivotally connected thereon. Links 100 are pivotally connected to nozzles 94 for oscillating nozzles 94 back and forth in a transverse direction. Suitable abrasive grit entrained in a high velocity air stream may be provided from discharge lines 38 to nozzles 94 with a separate line 38 to each nozzle 94.

Each housing section 78, 80 has on each end 82 thereof a roller bracket 106 secured therein. A roller 108 is mounted for rotation thereon and engages a side of pipe 10. Rollers 108 are mounted for horizontal adjustment to accommodate different diameter pipe 10. A releasably latch indicated generally at 109 is provided to secure housing sections 78, 80 together about pipe 10. A pair of spaced projections or eyes 110 extend upward from each upper side 86 on the edge thereof opposite pivot axes 76. A chain 112 extends between each eye 110 and a lifting frame or head 114 which is supported on frame 31. Lifting head 114 has a pair of parallel ends 116 to which chains 112 are connected. A central connecting web or plate 118 of lift head 114 has a slot 120 therein and a suitable lift hook 121 or the like supported by a cable from boom 22 may be inserted within slot 120 in plate 118 for lifting head 114 and carriage 28 such as shown in FIG. 4.

For assembly of housing 30 on pipe 10, upper frame 28 is first lowered onto pipe 10 with rollers 70 in contact with the upper surface of pipe 10. Then lifting head 114 is lowered onto frame 31 with housing sections 78, 80 pivoting about pivot axes 76 and pipe 10. Latch 109 is latched to releasably secure housing 30 about pipe 10. In this position carriage 28 with housing 30 in latched position is in an operable position.

For operation utilizing grit in a pressurized air stream, an operator supplies hydraulic fluid to hydraulic motors 96 for oscillating nozzles 94. Then, air operated valves 39 are opened by the operator to supply grit in high pressure air streams in lines 38 to nozzles 94 at a pressure of around 100 psi, for example. Hydraulic fluid is supplied to hydraulic motor 72 for propelling carriage 28 along pipe 10. In such manner a predetermined uniform rate of speed along pipe 10 for self propelled carriage 28 of around 950 feet per hour may be provided for a thirty (30) inch diameter pipe. After cleaning of pipe 10, the grit along with rust scales, dirt, paint, coating particles and the like fall to the bottom of housing 30 for return through a suitable discharge opening and vacuum line 40 to grit cleaner 42 for cleaning of the grit as well known in the art. The cleaned grit is returned to grit storage 34 for supply of grit to grit pots 36 for another cycle. In the event high pressure water is utilized as the cleaning material, pressurized water is supplied through line 38 to nozzles 94 on housing 30 and returned with entrained removed waste material from the lower discharge opening in enclosed housing 30 and return line 40. Then, the water and waste material may be separated and the water after being repressurized returned to nozzles 94 through line 38 for recirculation.

Figure 4:
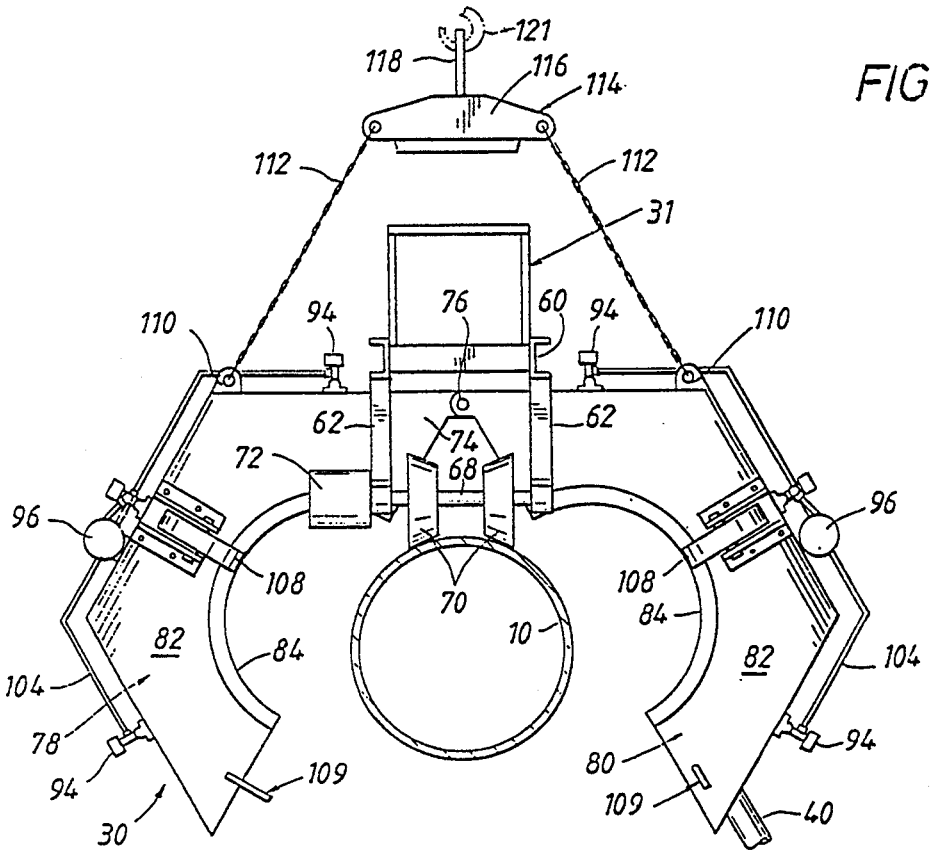
FIG. 4 is an end elevation similar to FIG. 3 but showing the housing halves pivoted to an opens position for assembly on and disassembly from the pipe.

For removal of carriage 28 from pipe 10, lift hook 121 is inserted within slot 120 and lifted by a cable from boom 22 after unlatching latch 109 to permit movement of housing sections 78, 80 to an open position as shown in FIG. 4. Upon contact of sections 78, 80 with frame members 60, further lifting of lift head 114 removes carriage 28 from pipe 10.

It is understood that other types of movement may be provided to nozzles 94 in order for nozzles 94 to cover the desired outer surface area of pipe 10 while utilizing a generally uniform diameter orifice. As shown in FIG. 7, a modification of the present invention is shown to add a circular movement to the pivoting movement of the nozzles. Nozzle 94A extends within an opening in side 86A and cleaning material is supplied through line 38A to nozzle 94A for discharge. Hydraulic motor 96A has an eccentric plate 98A and pivots arm 100A mounted on fixed ball joint 112A and movable ball joint 114A. Externally threaded rod 116A is adjustable on ball joint 114A by adjustment of nuts 118A and nozzle 94A is adjustable on ball joint 120A by sleeve 122A. The pivoting stroke of nozzle 94A may be adjusted by adjustment of ball joint 114A along threaded rod 116A, and by adjustment of nozzle 94A or ball joint 120A. Upon rotation of plate 98A ball 114A of connecting rod 100A moves in a direction to provide a generally circular pivoting motion.

Under certain conditions, the nozzles may be fixed on housing 30 particularly if a large number of nozzles, such as twelve nozzles, are positioned about pipe 10. When utilizing six nozzles, each nozzle covers an arc of around 60 degrees about the circumference of the pipe.

Figure 8:
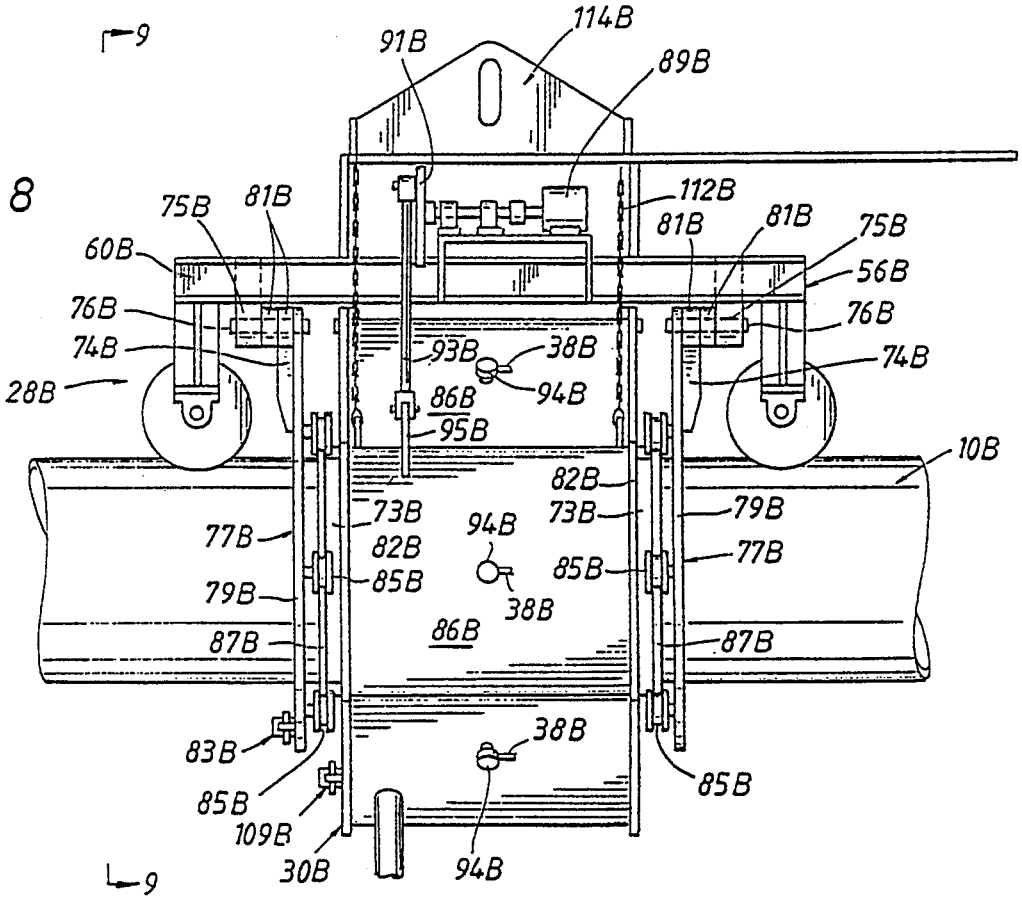
FIG. 8 is a side elevation of a further embodiment of the carriage of this invention in which the enclosed housing and nozzles thereon are mounted for oscillating movement relative to an upper support frame as the carriage travels along the pipe.
Figure 9:
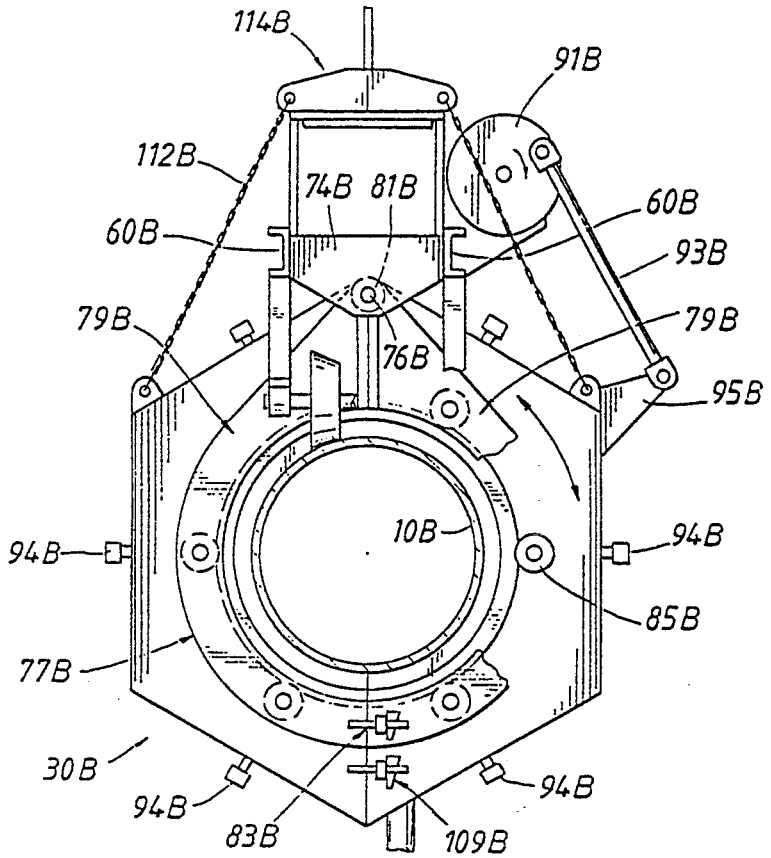
FIG. 9 is an end elevation taken generally along line 9—9 of FIG. 8 with a portion of the supporting frame for the housing being broken away.
Figure 10:
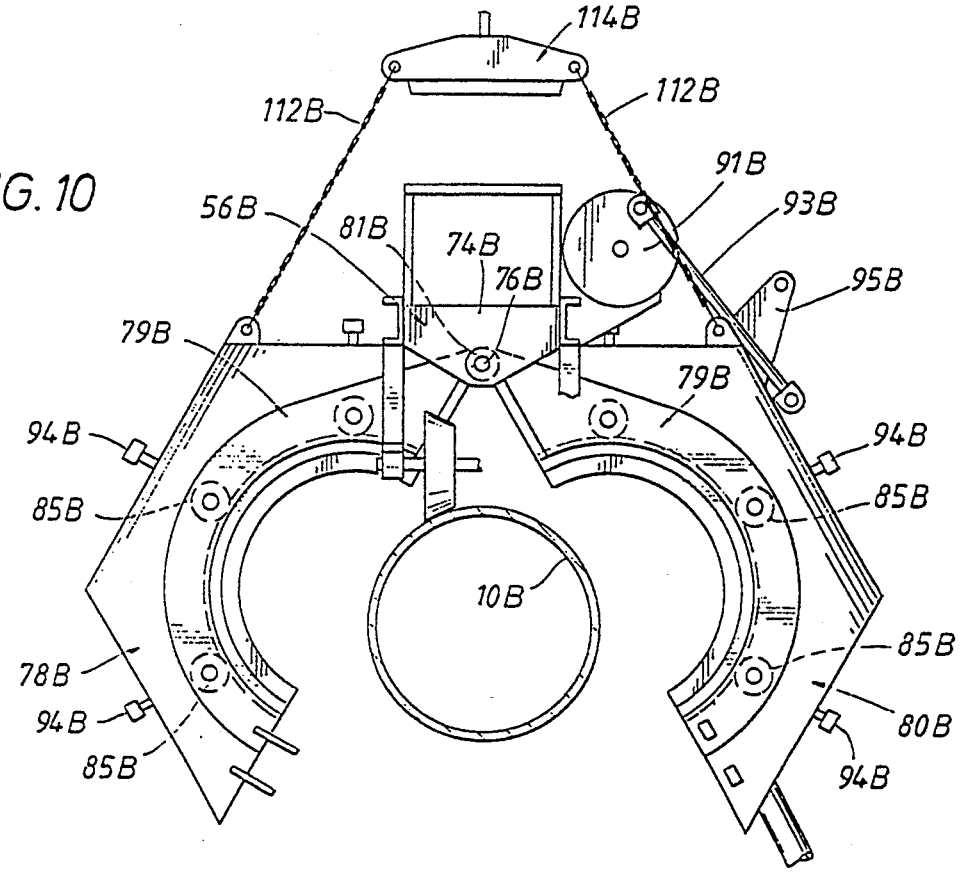
FIG. 10 is an end elevation of the carriage of FIG. 9 but showing the housing and the supporting frame pivoted to an open position for assembly on and disassembly from the pipe.
Figure 11:
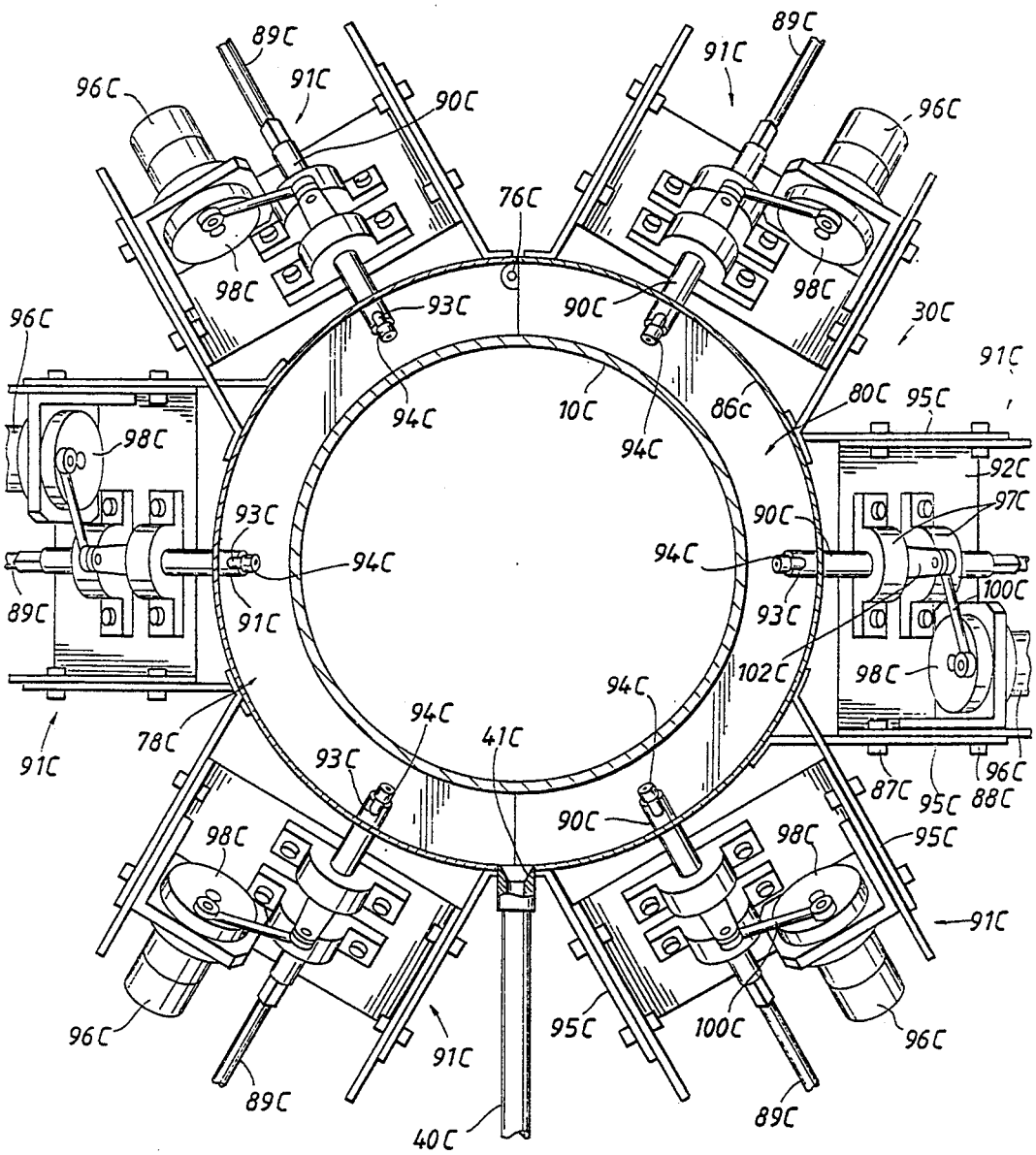
FIG. 11 is a transverse section of a further embodiment of the invention utilizing a plurality of nozzle units mounted externally on a housing about the pipeline for directing high pressure water against the pipeline.

Referring now to the embodiment shown in FIGS. 8–10, a carriage 28B having an upper support frame 56B Supports a separate housing 30B having fixed nozzles 94B thereon for oscillating movement relative to support frame 56B. Supply lines 38B for the pressurized cleaning material are connected to nozzles 94B for supplying the cleaning material in a pressurized stream. Carriage support frame 56B includes a pair of hanger brackets 74B secured between frame members 60B adjacent opposed ends 82B of housing 30B. Each bearing hanger bracket 74B has a bearing 75B mounting a shaft 76B for rotation. Mounted adjacent each end of housing 30B is an annular housing support member or yoke generally indicated at 77B. Each housing support member 77B includes a pair of complementary semicircular sections 79B each having a bearing 81B receiving shaft 76B to permit sections 79B to pivot about pipe 10B. A latch 83B is provided to secure sections 79B in position about pipe 10B. Each semicircular section 79B has three grooved rollers 85B mounted therein adjacent housing 30B and spaced from each other at an arc of 60 degrees.

Each housing end 82B has an extension 73B with an annular flange 87B thereon adjacent each end 82B of housing halves 78B, 80B. Flanges 87B are received within grooves in rollers 85B to provide longitudinal movement of housing 30B with carriage 28B but permit rotative movement of housing 30B relative to support frame 56B and yokes 77B of carriage 28B. Housing halves or sections 78B and 80B function similarly to housing sections 78, 80 in the embodiment of FIGS. 2–6 and are connected by chains 112B to lifting head 114B for pivoting and lifting.

To oscillate housing 30B back and forth through an arcuate travel of around sixty degrees, for example, a hydraulic motor 89B mounted on carriage frame 56B has an eccentric 91B for movement of link 93B connected between eccentric 91B and a lug 95B secured to a side 86B of housing 30B. Upon supplying fluid to hydraulic motor 89B, housing 30B with fixed nozzles 94B move back and forth on rollers 85B in an arcuate movement relative to carriage frame 30B. Upon pivoting of housing sections 58B, 60B for removal from pipe 10B as shown in FIG. 10, link 93B is disconnected along with latches 83B and 109B.

Referring now to FIGS. 11–14, an embodiment is illustrated particularly for a water jetting apparatus and method for cleaning the exterior surface of a pipeline including directing pressurized water at a very high pressure, such as a pressure between 20,000 psi and 40,000 psi against the surface of the pipeline. A self propelled carriage for travelling along pipe 10C similar to carriage 28 in the embodiment of FIGS. 1–5 is provided for supporting housing 30C from supports 74C of the carriage indicated partially at 28C in FIG. 12. Housing 30C supported from the carriage has a pair of spaced parallel ends 82C and a peripheral cylindrical wall 86C secured between parallel ends 82C to form a generally cylindrical housing 30C about pipeline 10C. Housing 30C includes two sections 78C, 80C pivoted to each other at 76C for swinging outwardly for removal of housing 30C from pipe 10C and swinging inwardly for mounting of housing 30C about pipe 10C. Housing 30C has a return line 40C connected to a discharge opening 41C in the bottom of housing 30C to return the discharged water and removed waste material to adjacent mobile apparatus alongside pipe 10C similar to the trailer or skid 26 shown in FIG. 1 for the embodiment of FIGS. 1–5. The waste material is removed from the water by filtering and may be separately collected for disposal. The filtered water may be cooled and pressurized for return to housing 30C in a continuous recirculating water system. A suitable water supply and pump may be provided on skid 26 for the continuous recirculation system as shown further schematically in FIG. 15.

Mounted on housing 30C are six generally similar nozzle units designated generally at 91C and for the purposes of illustration only one nozzle unit 91C will be described in detail. Each nozzle unit 91C is mounted for cleaning an arcuate surface portion of pipeline 10C of around 65 degrees so that the entire outer periphery of pipeline 10C is cleaned as self propelled carriage or vehicle 28C travels along pipeline 10C. Nozzle unit 91C has a channel-shaped supporting base 92C with side flanges thereof pivoted about bolts 87C to bracket arms 95C. Base 92C is mounted for pivotal adjustment by adjusting bolts 88C received within arcuate slots 85C in the side flanges. High pressure water at a pressure between around 20,000 psi and 40,000 psi is supplied through flexible hose 89C and hollow shaft or tube 90C to nozzle arm 93C having a nozzle or nozzle head 94C on its outer end for the discharge of high pressure water against the outer surface of pipeline 10C from an orifice in nozzle head 94C. Tube 90C is received within an elongate slot 99C in peripheral wall 86C of housing 30C and mounted for pivotal back and forth movement within bearings 97C secured to supporting base 92C. For pivoting tube or tubular shaft 90C back and forth, a hydraulic motor 96C mounted on supporting base 92C rotates an eccentric 98C having a link 100C pivotally connected at 101C to an arm 102C fixed to tube 90C as shown particularly in FIG. 13. It is desired that nozzle 94C during its pivoting back and forth movement or stroke trace a path 103C which is generally equidistant from the outer surface of pipeline 10C throughout its stroke so that nozzle 94C remains at a generally constant distance from the outer surface of pipeline 10C during its entire travel in order to provide a uniform cleaning action of the high pressure water jet against the outer surface of pipeline 10C.

To accomplish this desired movement and referring to FIG. 14, the longitudinal axis of tubular nozzle arm 93C at the center of the stroke of nozzle 94C preferably is parallel to the longitudinal axis L of pipeline 10C as shown in FIG. 14. The longitudinal axis of tube 90C preferably intersects the longitudinal axis of pipeline 10C at an angle A of around 120 degrees. An angle A between around 100 degrees and 140 degrees is believed to be satisfactory under certain conditions. The high pressure jet of water discharged from nozzle 94C forms a stream 104C having its centerline at an angle B of around 60 degrees relative to the longitudinal axis of nozzle arm 93C. An angle B between around 40 degrees and 80 degrees would be satisfactory under certain conditions. Thus, the high pressure water stream or jet strikes or impacts the outer surface of pipeline 10C at an acute angle to facilitate the removal of rust, scales, or other material on the outer surface of pipeline 10. Nozzle 94C is preferably spaced a distance D of around ½ inch from the adjacent outer periphery of pipeline 10C.

A distance D between ¼ inch and two inches is believed necessary in order to provide the desired impact of the high pressure water stream or jet against the outer surface of pipeline 10C. During the pivoting movement of nozzle 94C, distance D may vary slightly from the center of the arcuate path 103C traced by the water jet to the end of the path but the variance should not be more than around ¼ inch to ½ inch for best results. A constant distance D of the orifice of nozzle head 94C from the outer periphery of pipeline 10A is desirable however in order to provide a uniform cleaning action.

As a specific but non-limiting example with the self propelled carriage and housing 30C travelling along pipe 10C at the rate of around 5 feet per minute, orifices of nozzles 94C are spaced a distance D of ¼ inch from the outer surface of pipe 10C and the width of the arcuate path or band 103C on pipe 10C is around 1/16 inch. Nozzles 94C are oscillated at a rate of 500 cycles per minute and the pressure of the water is around 25,000 psi. Nozzles 94C may be oscillated satisfactorily between around 300 cycles per minute and 1,000 cycles per minute. If the rate of travel of housing 30C along pipe 10C is increased to around 10 feet per minute the number of cycles per minute of nozzles 94C would likewise increase. At higher pressures such as 35,000 psi for example a wider arcuate path 103C of around ¼ inch to ½ inch may be obtained in a satisfactory manner.

Figure 12:
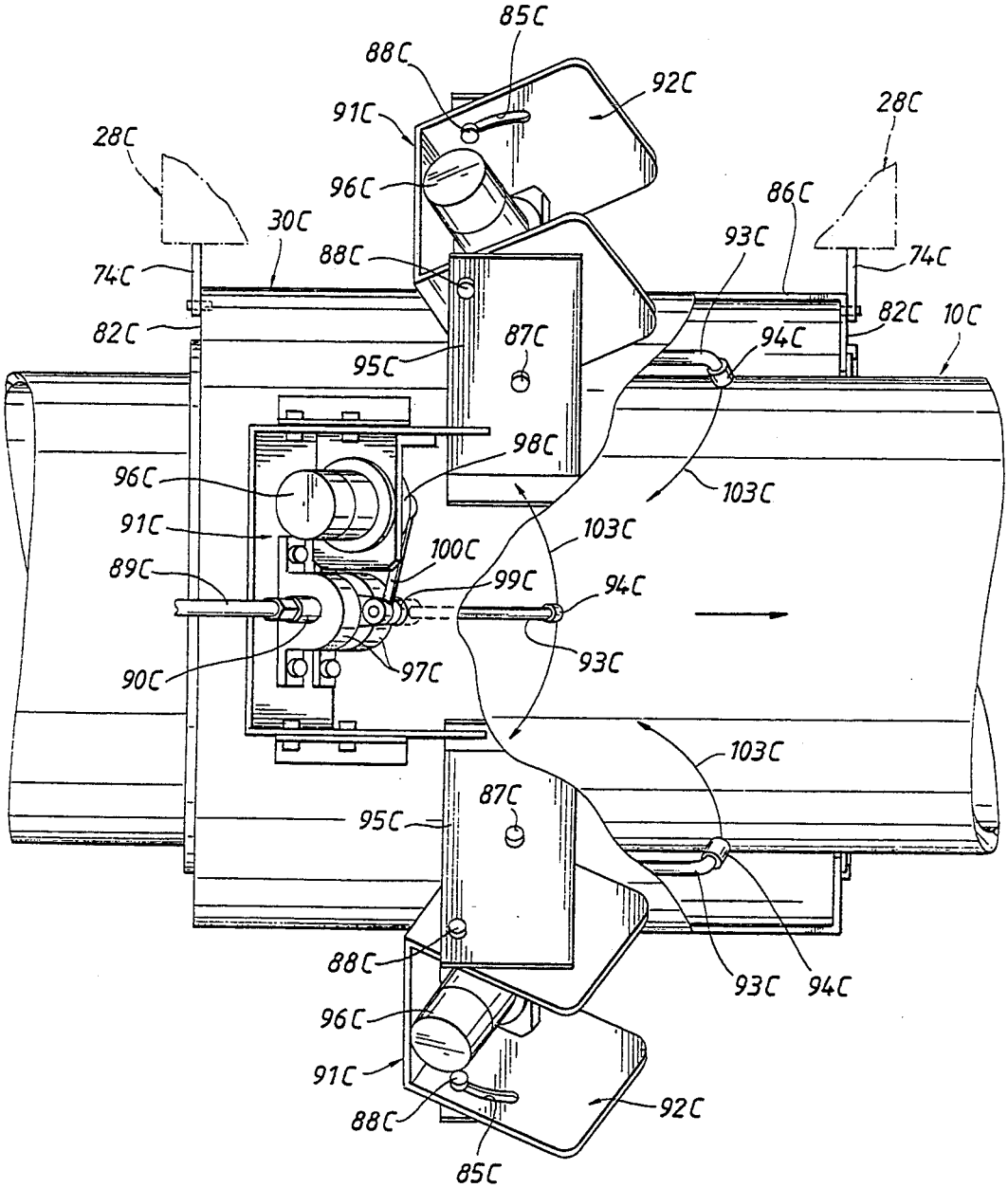
FIG. 12 is a plan of the housing shown in FIG. 11 showing a plurality of nozzle units each including a pivoting nozzle and drive means for pivoting the nozzle in an arcuate path generally conforming to the adjacent outer surface of the pipeline.
Figure 13:
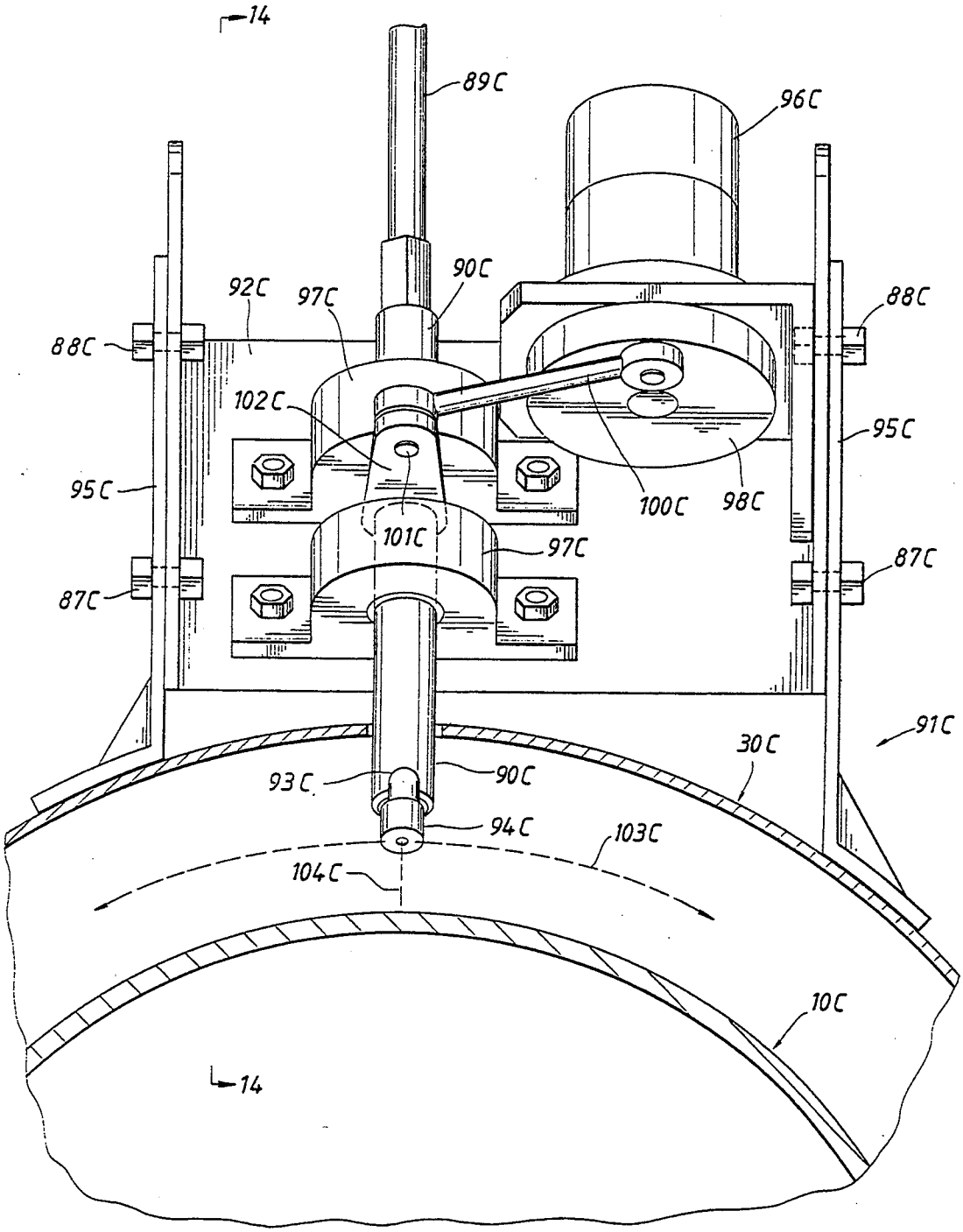
FIG. 13 is an enlarged elevation of a nozzle unit showing the nozzle adjacent the outer surface of the pipeline in a centered position.

Pipeline 10C may be of various diameters, such as 24 inches, 36 inches and 48 inches in diameter. The longitudinal axis of shaft 90C is positioned at an angle C of around 30 degrees relative to a vertical axis. Shaft 90C is mounted for adjustable movement about pivot 87C by adjustment of adjusting bolts 88C mounted within arcuate slots 85C for movement to a desired position. Thus, angle C may vary between 0 degrees and 40 degrees as may be desired dependent primarily on such factors as the diameter of pipeline 10C, the length of nozzle arm 93C, and angle A. While six nozzle units 91C are illustrated, it is to be understood that the number of nozzle units 91C would vary between four units and twelve units depending on the diameter of pipeline 10C. If six nozzle units 91C are employed, the high pressure water jet from each nozzle 94C transcribes a generally arcuate path 103C of around 60–65 degrees along the outer surface of pipeline 10C with a slight overlapping of the arcuate paths from adjacent nozzles 94C as shown in FIG. 12. The length of link arms 100C may be varied to vary the movement of the associated nozzle 94C.

The bottom of housing 30C has a discharge opening 41C in communication with a connected flexible discharge hose or line 40C for return of the discharged water and removed waste material to mobile collection equipment alongside pipeline 10C such as skid 26 shown in FIG. 1 moving along the ground surface adjacent the pipeline 10C to provide power and supplies of water as needed. The filtered water after repressurizing is returned to housing 30C for cleaning of pipeline 10C in a continuous recirculating water system. The collected waste material may be removed from the collection to a separate disposal site if desired. Hydraulic fluid for driving hydraulic motor 96C is provided by suitable hoses to each motor 96C from a hydraulic pump and fluid reservoir on the skid or trailer adjacent pipeline 10C.

Referring to FIG. 15, a recirculating water system for nozzles 94C is shown schematically which may be mounted on a skid or trailer alongside pipeline 10C as illustrated by skid 26 in FIG. 1. Enclosed housing 30C has nozzles 94C and hollow shafts or tubes 90C mounted thereon. Water is supplied from a water tank or reservoir 36C by pump 108C through line 38C to manifold 107C and lines 89C to housing 30C. A hydraulic fluid motor 110C drives pump 108C to supply pressurized water through line 38C to nozzles 94C. Water is supplied to pump 108C through line 112C from reservoir 36C. Water and entrained waste material are removed from the bottom of housing 30C through bottom discharge opening 41C and lines 40C and 46C to a filter 114C. The waste material is collected in suitable bags or containers at 116C for transportation to a remote disposal site. The water is returned to reservoir 36C by pump 118C driven by hydraulic motor 120C through return line 122C and cooled by a cooler 123C if desired. Recirculation of the cooled water by pump 108C to nozzles 94C on housing 30C then occurs. Hydraulic fluid is supplied by a hydraulic pump to fluid motors 110C and 120C similar to FIG. 1.

Referring to FIG. 16, a separate embodiment of the high pressure water cleaning apparatus of FIGS. 11–15 is shown generally schematically in which a housing 30D similar to housing 30C is shown in a fixed relation supported on fixed supports 124D. Pipe 10D is supported on powered rollers 126D which move pipe 10D longitudinally through housing 30C. Nozzle units 91D similar to nozzle units 91C in the embodiment of FIGS. 11–14 are mounted on housing 30D for the cleaning of the outer surface of pipe 10D as it moves through housing 30D. The recirculation system shown in FIG. 15 is applicable to the embodiment of FIG. 16.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. Apparatus for cleaning a pipeline supported above the ground adjacent a ditch for subsequent application of a coating; said apparatus comprising:

means for supporting the pipeline above the ground;

mobile means adjacent a side of the pipeline to be cleaned providing a power source and a source of cleaning material thereon;

a self propelled carriage adjacent said mobile means adapted to be supported on the outer surface of the pipeline for movement along the pipeline to clean the exterior surface of the pipeline, said self propelled carriage including:

a housing having a pair of spaced opposed ends with aligned openings therein for receiving the pipeline and an outer peripheral wall secured between said opposed ends and adapted to extend about the pipeline to form an enclosed cleaning chamber;

rollers supporting said housing for movement along the pipeline;

a plurality of nozzles mounted on said housing and spaced at intervals about the outer peripheral wall of said housing, said nozzles having inner ends for discharge of pressurized cleaning material in a high velocity stream within said enclosed cleaning chamber against said pipeline;

pressurized fluid lines extending from said source of cleaning material on said mobile means to said nozzles for discharge of cleaning material in a pressurized stream from said nozzles; and drive means mounted externally on said housing to move said nozzles in a predetermined stroke for cleaning a predetermined surface area on the outer surface of the pipeline.

2. Apparatus as set forth in claim 1 wherein said housing including said ends and aligned openings has an arcuate portion thereof mounted for swinging movement between open and closed positions about said pipeline in a plane extending perpendicularly to the longitudinal axis of the pipeline thereby to permit assembly about the pipeline and removal from the pipeline.

3. Apparatus as set forth in claim 1 wherein said drive means to move said nozzles includes a fluid operating drive motor mounted externally on said peripheral wall of said housing, said drive motor having a power output and a connecting arm eccentrically mounted on said power output operatively connected to an associated nozzle for moving said associated nozzle in a predetermined path.

4. A self propelled carriage adapted to be supported on the outer surface of pipe for movement along the pipe and adapted to be connected to a source of pressurized cleaning material to clean the outside of the pipe; said carriage comprising:

a housing having a pair of opposed ends with aligned openings therein adapted to receive the pipe therein, and an outer peripheral wall secured between said ends and adapted to extend about the pipe to form an enclosed cleaning chamber;

supporting means for said housing having rollers mounted thereon for contact with the outer surface of the pipe;

said housing supported by said rollers on said pipe and including a side section pivotally mounted for swinging movement to an open position to receive said pipe therebetween;

a plurality of nozzles mounted on said housing and spaced at intervals about said outer peripheral wall, said nozzles adapted to be connected to said source of pressurized cleaning material externally of said housing and having inner ends for discharge of pressurized cleaning material in a high velocity stream against said pipe; and fluid motor drive means mounted externally on said housing to move said nozzles in a predetermined stroke for cleaning a predetermined surface area on the outside of the pipe.

5. A self propelled carriage as set forth in claim 4 wherein said drive means comprises a plurality of fluid operated motors mounted externally on said housing and connecting arms externally of said housing operatively connected between said motors and said nozzles for moving said nozzles in a predetermined path.

6. A carriage as set forth in claim 4 wherein separate drive means is provided for each nozzle comprising a fluid motor having a drive plate thereon and a connecting arm for each nozzle mounted eccentrically on the drive plate and operatively connected to a respective nozzle for providing a predetermined pivotal motion to the nozzle upon rotation of said drive plate.

7. Apparatus for cleaning the outer surface of pipe comprising:

a support frame supported on the outer surface of said pipe for longitudinal movement along the said pipe;

a housing mounted on said support frame and adapted for fitting about said pipe to form an enclosed chamber extending about the entire outer periphery of said pipe;

a plurality of nozzles mounted on said housing and spaced about the periphery of said pipe for the discharge of cleaning material against the outer periphery of said pipe;

means extending between said housing and said support frame for oscillating said housing and nozzles mounted thereon in a predetermined stroke in a direction transverse to the longitudinal axis of said pipe relative to said outer periphery of said pipe to permit said nozzles to discharge cleaning material against the entire outer periphery of said pipe;

said housing having a discharge opening for receiving the cleaning material and entrained waste material from the enclosed cleaning chamber after the cleaning operation; and conduit means connected to said discharge opening for the conveyance of the cleaning material and waste material away from said housing.

8. Apparatus as set forth in claim 7 wherein said cleaning material is pressurized water and means are provided adjacent said housing to receive the water and waste material from said conduit means and to separate the waste material from the water; and means are provided to pressurize and return the separated water to said housing for discharge from said nozzles.

9. A self propelled carriage adapted to be supported on the outer surface of pipe for movement along the pipe and adapted to be connected to a source of pressurized cleaning material to clean said outer surface of the pipe; said carriage comprising:

a housing having a pair of opposed ends with aligned openings therein adapted to receive the pipe therein, and an outer peripheral wall secured between said ends and adapted to extend about the pipe to form an enclosed cleaning chamber;

supporting means for said housing having rollers mounted thereon for contact with the outer surface of the pipe;

said housing supported by said rollers on said pipe and including a side section pivotally mounted for swinging movement to an open position to receive said pipe therebetween; and a plurality of nozzle units mounted externally on said housing and spaced at arcuate intervals about said outer peripheral wall, each nozzle unit including a nozzle adapted to be connected to a source of pressurized water for discharge in a high velocity stream against the outer surface of said pipe, and drive means operatively connected to said nozzle for pivoting said nozzle in a predetermined stroke for cleaning a predetermined area on the outer surface of said pipe.

10. A self propelled carriage as set forth in claim 9 wherein a supporting base for each nozzle unit is secured to said housing and supports the nozzle unit thereon, each nozzle unit including a hollow shaft mounted on said supporting base for pivotal back and forth movement and adapted to be connected to a flexible water supply hose for the supply of pressurized water to said shaft, said nozzle being connected to said hollow shaft for the supply of pressurized water thereto for discharge.

11. A self propelled carriage as set forth in claim 10 wherein said nozzle comprises a nozzle tube connected to said shaft, and a nozzle head connected to the extending end of said nozzle tube and defining an orifice for the discharge of a stream of pressurized water therefrom against the outer surface of said pipe.

12. A self propelled carriage as set forth in claim 11 wherein the centerline of said stream of pressurized water discharged from said orifice is at an angle between around 40 degrees to 80 degrees relative to the longitudinal axis of said pipe.

13. A self propelled carriage as set forth in claim 9 wherein said drive means comprises a hydraulic fluid motor, and linkage means extend between said fluid motor and said nozzle for pivoting of said nozzle in a predetermined stroke.

14. A self propelled carriage as set forth in claim 9 wherein a supporting base mounts each of said nozzle units on said housing, and means mount said supporting base on said housing for limited relative pivotal movement in a direction generally parallel to the longitudinal axis of said pipe.

15. A self propelled carriage as set forth in claim 9 wherein support means secured to said housing is provided for each nozzle unit to mount the associated nozzle unit to the housing, the associated nozzle unit including a water supply pipe fixed to said support means for the supply of water to the associated nozzle and adapted to be connected to a flexible water supply hose for the supply of pressurized water to the associated nozzle.

16. A self propelled carriage as set forth in claim 9 wherein a pair of spaced bearings are mounted on said support means and receive said water pipe thereon for relative rotative movement; and said drive means includes linkage means connected to said water pipe for pivoting said water pipe back and forth, said nozzle being in fluid communication with said water pipe and operatively connected thereto for movement back and forth along a predetermined arcuate path along the outer surface of said pipe.

17. A self propelled carriage as set forth in claim 16 wherein said nozzle has an orifice spaced less than around two inches from the outer surface of said pipe and varying in distance from the outer surface of said pipe an amount less than around $\frac{3}{8}$ inch throughout the arcuate path of the nozzle.

18. Apparatus adapted to be connected to a source of pressurized water for cleaning the outer surface of pipe; said apparatus comprising:

a housing having a pair of opposed ends with aligned openings therein adapted to receive the pipe therein, and an outer peripheral wall secured between said ends and adapted to extend about the pipe to form an enclosed cleaning chamber; and a plurality of nozzle units mounted externally on said housing and spaced at arcuate intervals about said outer peripheral wall, each nozzle unit including a nozzle adapted to be connected to a source of pressurized water for discharge in a high velocity stream against the outer surface of said pipe, and drive means on said housing operatively connected to said nozzle for pivoting said nozzle in a predetermined stroke for cleaning a predetermined area on the outer surface of said pipe.

19. Apparatus as set forth in claim 18 wherein each nozzle unit includes a tubular shaft mounted on said housing for pivotal back and forth movement and adapted to be connected to a flexible water supply hose for the supply of pressurized water to said shaft, said nozzle being connected to said tubular shaft for the supply of pressurized water thereto for discharge.

20. Apparatus as set forth in claim 19 wherein said nozzle comprises a nozzle tube connected to said shaft, and a nozzle head connected to the extending end of said nozzle tube and defining an orifice for the discharge of a stream of pressurized water therefrom against the outer surface of said pipe.

21. Apparatus as set forth in claim 18 wherein said drive means comprises a hydraulic fluid motor, and linkage means extend between said fluid motor and said nozzle for pivoting of said nozzle in a predetermined stroke.

22. Apparatus as set forth in claim 18 wherein a carriage is mounted on said pipe for travel along the pipe and supports said housing thereon.

23. Apparatus as set forth in claim 18 wherein said housing is fixed and means move said pipe longitudinally through said housing for cleaning said outer surface of said pipe.

24. Apparatus as set forth in claim 19 wherein said housing has an opening therein receiving said tubular shaft, and said nozzle includes a nozzle tube within said housing connected to an end Of said tubular shaft to receive pressurized water therefrom.

* * * * *